US006501252B2

(12) United States Patent
Fujise

(10) Patent No.: US 6,501,252 B2
(45) Date of Patent: Dec. 31, 2002

(54) POWER SUPPLY CIRCUIT

(75) Inventor: Takashi Fujise, Nagano-ken (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 09/975,733

(22) Filed: Oct. 11, 2001

(65) Prior Publication Data

US 2002/0057083 A1 May 16, 2002

(30) Foreign Application Priority Data

Oct. 12, 2000 (JP) ..... 2000-312392

(51) Int. Cl.[7] ..... G05F 1/40

(52) U.S. Cl. ..... 323/274; 323/280; 323/281; 323/316; 327/541; 327/542; 330/269; 330/271; 330/255

(58) Field of Search ..... 323/279, 274, 323/280, 281, 315, 316, 224; 327/391, 540, 541, 542, 543; 330/269, 271, 255

(56) References Cited

U.S. PATENT DOCUMENTS 5,545,970 A * 8/1996 Parkes et al. ..... 323/273
5,874,830 A * 2/1999 Baker ..... 323/316
5,986,910 A * 11/1999 Nakatsuka ..... 323/316
6,188,211 B1 * 2/2001 Rincon-Mora et al. ..... 323/273
6,333,623 B1 * 12/2001 Heisley et al. ..... 323/224

* cited by examiner

*Primary Examiner*—Shawn Riley
(74) *Attorney, Agent, or Firm*—Harness, Dickey & Pierce, P.L.C.

(57) ABSTRACT

A power supply circuit is equipped with a first amplification path 10 in which a first potential is input and that supplies current to an output terminal when a control signal is in a first state; a second amplification path 20 in which a second potential is input and that absorbs current from the output terminal when a control signal is in a second state; an intermediate potential forming circuit that forms a third potential between the first potential and the second potential; and a comparison circuit 30 that compares the third potential with a potential at the output terminal to form a control signal and supplies the same to the first and second amplification paths.

20 Claims, 4 Drawing Sheets

POWER SUPPLY CIRCUIT

BACKGROUND OF THE INVENTION

Technical Field of the Invention

The present invention relates to a power supply circuit such as a LCD driver, and more particularly to a voltage follower type power supply circuit that supplies loads by a push-pull method.

Conventional Technology

In the conventional power supply circuits such as LCD drivers, a push-pull type shown in FIG. 5 is known. The power supply circuit shown in FIG. 5 includes a first amplification path 100 that supplies current to an output terminal using a P-channel transistor at its output stage, and a second amplification path 200 that absorbs current from the output terminal using an N-channel transistor in its output stage. The power supply circuit is fed with a first potential $V_{10}$ and a second potential $V_{20}$ that are obtained by voltage-dividing an input potential $V_H$ at a high potential side and an input voltage $V_L$ at a lower potential side by resistors R10, R20 and R30. Since the second potential $V_{20}$ at a lower side is supplied to the first amplification path 100, and the first potential $V_{10}$ at a higher side is supplied to the second amplification path 200, the output transistor of the first amplification path 100 and the output transistor of the second amplification path 200 do not normally operate at the same time.

However, when threshold voltage or the like of transistors that for differential pairs of differential amplifiers included in the first amplification path 100 or second amplification path 20 changes due to process deviations, a problem occurs in that the output transistor of the first amplification path 100 and the output transistor of the second amplification path 200 may operate at the same time, and in this instance, a large current flows. On the other hand, when a value of the resistor R20 is increased to increase an offset between the first potential $V_{10}$ and the second potential $V_{20}$, a problem occurs in that the output voltage of the power supply circuit fluctuates in a wave-like manner.

It is noted that Japanese laid-open patent application SHO61-79312 describes a DC amplifier equipped with an offset adjustment device that controls the midpoint of the common source resistance of a first stage amplifier by inputting a direct current component included in an output of the amplifier in a window comparator and, when it exceeds a specified level, sending control signals to a multiplexer successively by operating a comparison resistor.

Also, Japanese laid-open patent application HEI 7-106875 describes a semiconductor integrated circuit equipped with differential transistors, a power supply transistor connected to commonly connected source electrodes of the differential transistors, a resistor and a power supply transistor connected in parallel therewith, a comparator that compares voltages of both ends of the resistor with a reference voltage and feeds back an output to the two power supply transistors.

However, the techniques described in these references are provided for adjusting a DC offset of an output potential, but not for controlling a push-pull operation at an output stage.

In view of the above, it is an object of the present invention to provide a power supply circuit that supplies power to a load by a push-pull method in which operations of a P-channel transistor and an N-channel transistor in an output stage are controlled, such that large currents that may flow due to process deviations or the like can be prevented.

SUMMARY OF THE INVENTION

To solve the problems described above, a power supply circuit in accordance with the present invention comprises: a first amplification path in which a first potential is input and that supplies current to an output terminal when a control signal is in a first state; a second amplification path in which a second potential is input and that absorbs current from the output terminal when a control signal is in a second state; an intermediate potential forming circuit that forms a third potential between the first potential and the second potential; and a comparison circuit that compares the third potential and a potential at the output terminal to form a control signal and supplies the same to the first and second amplification paths.

In the above embodiment, the first amplification path may include a negative feedback amplifier that uses a P-channel transistor at an output stage, and the second amplification path may include a negative feedback amplifier that uses an N-channel transistor at an output stage.

Also, the intermediate potential forming circuit may form the third potential by voltage-dividing the first potential and the second potential.

By the power supply circuit of the present invention having the structure described above, the third potential that defines a reference potential and a potential at the output terminal are compared to control the operations of the first and second amplification paths, whereby large currents that may flow due to process deviations or the like can be prevented.

DETAILED DESCRIPTION OF THE PREFERRED EMBODIMENTS

Embodiments of the present invention are described with reference to the accompanying drawings.

Figure 1:
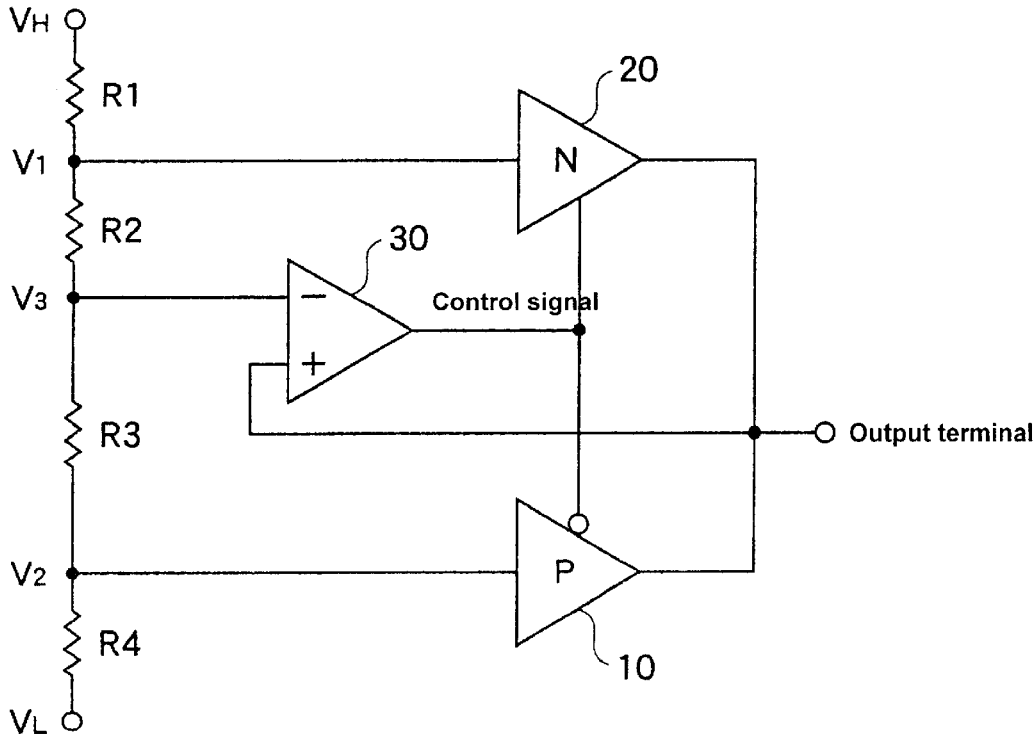
FIG. 1 shows a structure of a power supply circuit in accordance with a first embodiment of the present invention.

FIG. 1 shows a structure of a power supply circuit in accordance with a first embodiment of the present invention. As shown in FIG. 1, the power supply circuit includes a first amplification path 10 that supplies current to an output terminal using a P-channel transistor at its output stage, and a second amplification path 20 that absorbs current from the output terminal using an N-channel transistor provided at its output stage.

Figure 2:
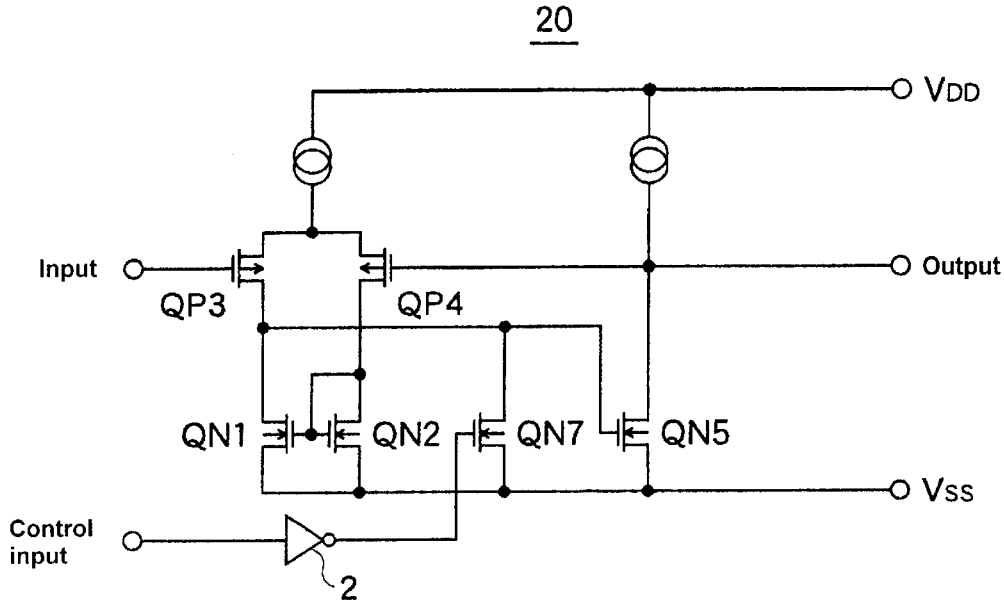
FIG. 2 shows a circuit example of a second amplification path shown in FIG. 1.

FIG. 2 shows a circuit example of the second amplification path 20. The second amplification path 20 includes a differential amplifier formed from N-channel transistors QN1~QN2 and P-channel transistors QP3~QP4, an N-channel transistor QN5 at an output stage, and an N-channel transistor QN7 that turns on and off the transistor at the output stage. When a control signal applied to a control input becomes a high level, an output of an inverter 2 becomes a low level, such that the transistor QN7 turns off and the transistor QN5 at the output stage operates. On the other hand, when a control signal applied to the control input becomes a low level, an output of the inverter 2 becomes a high level, such that the transistor QN7 turns on and the transistor QN5 at the output stage turns off.

Figure 3:
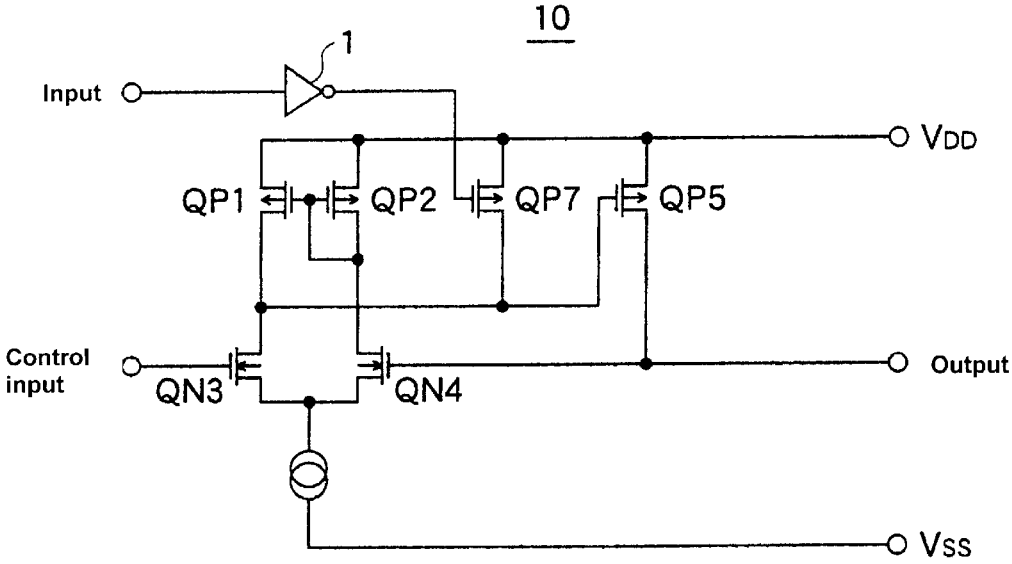
FIG. 3 shows a circuit example of a first amplification path shown in FIG. 1.

FIG. 3 shows a circuit example of the first amplification path 10. The first amplification path 10 includes a differential amplifier formed from P-channel transistors QP1~QP2 and N-channel transistors QN3~QN4, a P-channel transistor QP5 at 5i: an output stage, and a P-channel transistor QP7 that turns on and off the transistor at the output stage. When a control signal applied to a control input becomes a high level, an output of an inverter 1 becomes a low level, such that the transistor QP7 turns on and the transistor QP5 at the output stage turns off. On the other hand, when a control signal applied to the control input becomes a low level, an output of the inverter 1 becomes a high level, such that the transistor QP7 turns off and the transistor QP5 at the output stage operates.

Referring again to FIG. 1, the power supply circuit is fed with a first potential $V_1$ and a second potential $V_2$ that are obtained by voltage-dividing an input potential $V_H$ at a high potential side and an input voltage $V_L$ at a lower potential side by resistors R1~R4. Also, a third potential V3 between the first potential $V_1$ and the second potential $V_2$ is fed to an inversion input of a comparator circuit 30. A non-inversion input of the comparator circuit 30 connects to the output terminal. The comparator circuit 30 outputs a control signal to be supplied to the first amplification path 10 and the second amplification path 20.

As a result, when a potential at the output terminal is higher than the third potential $V_3$, the control signal becomes a high level, and only the second amplification path 20 operates. On the other hand, when a potential at the output terminal is lower than the third potential $V_3$, the control signal becomes a low level, and only the first amplification path 10 operates. As a result, the first amplification path 10 and the second amplification path 20 do not simultaneously operate, such that large current that may flow due to process deviations can be prevented.

Also, an offset between the first potential $V_1$ and the second potential $V_2$ does not need to be made large. As a result, the problem in which the output voltage of the power supply circuit fluctuates in a wave-like manner can also be solved.

Figure 4:
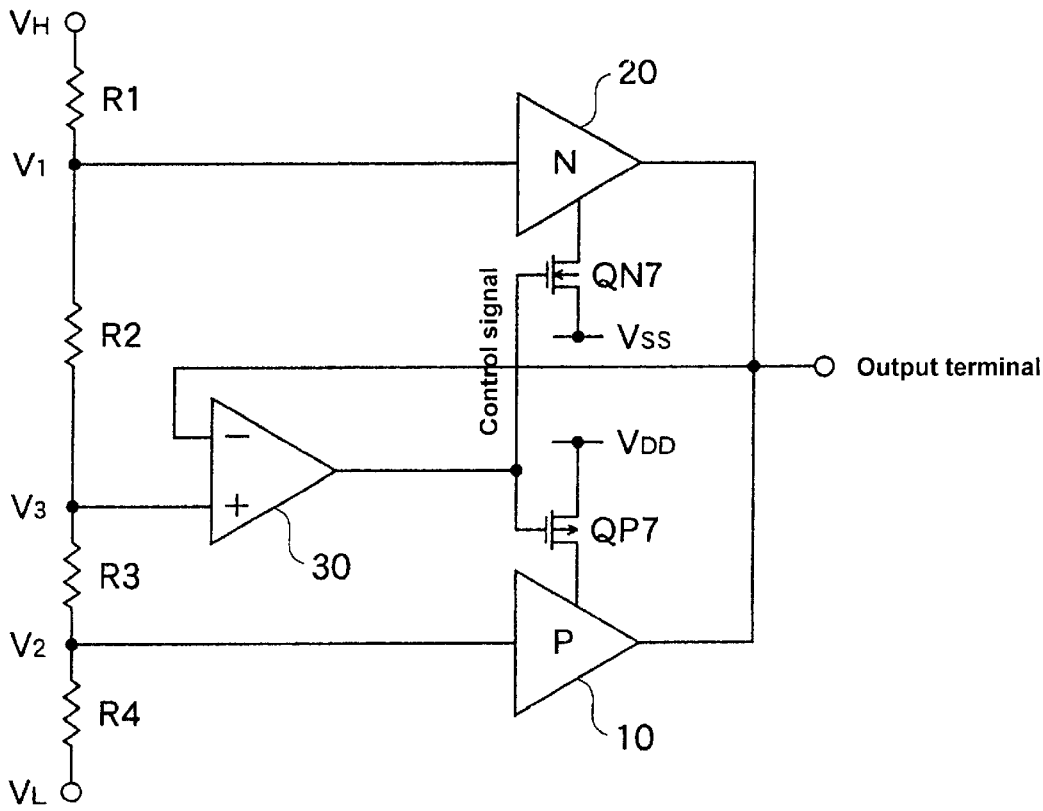
FIG. 4 shows a structure of a power supply circuit in accordance with a second embodiment of the present invention.
Figure 5:
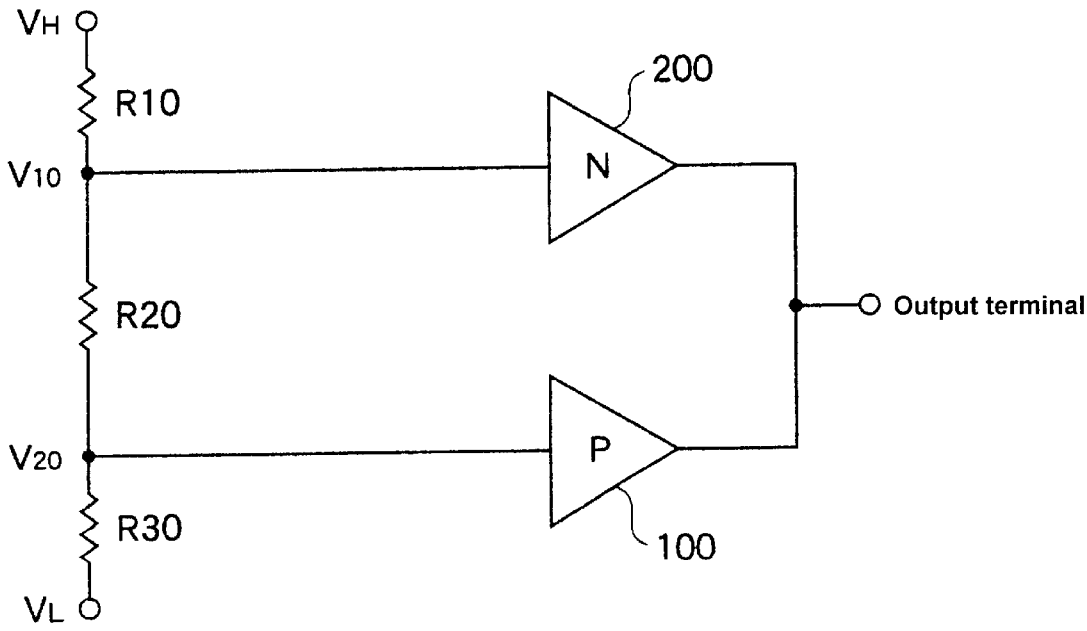
Fig. 5 PRIOR ART
FIG. 5 shows a structure of a conventional power supply circuit.

Next, a power supply circuit in accordance with a second embodiment of the present invention is described with reference to FIG. 4. As shown in FIG. 4, in the present embodiment, the inverter 2 is omitted by directly inputting a control signal that is output from the comparator circuit 30 in the transistor QN7 (see FIG. 2) of the second amplification path 20. Similarly, the inverter 1 is omitted by directly inputting a control signal that is output from the comparator circuit 30 in the transistor QP7 (see FIG. 3) of the first amplification path 10. Also, a third potential $V_3$ is fed in the non-inversion input of the comparator circuit 30, and an inversion input of the comparator circuit 30 is connected to the output terminal.

As a result, when a potential at the output terminal is higher than the third potential $V_3$, the control signal becomes a low level, and only the second amplification path 20 operates. On the other hand, when a potential at the output terminal is lower than the third potential $V_3$, the control signal becomes a high level, and only the first amplification path 10 operates. As a result, in a similar manner as the first embodiment, the first amplification path 10 and the second amplification path 20 do not simultaneously operate, such that large current that may flow due to process deviations can be prevented.

As described above, in accordance with the present invention, in a power supply circuit that supplies power to a load by a push-pull method, a reference potential formed from input potentials and a potential at an output terminal are compared to thereby control operations of first and second amplification paths. As a result, large currents that may flow due to process deviations or the like can be prevented.

The entire disclosure of Japanese Patent Application No. 2000-312392 (P) filed Oct. 12, 2000 is incorporated herein by reference.

What is claimed is:

1. A power supply circuit comprising:

a first amplification path in which a first potential is input and that supplies a current to an output terminal when a control signal is in a first state;

a second amplification path in which a second potential is input and that absorbs current from the output terminal when a control signal is in a second state;

an intermediate potential forming circuit that forms a third potential between the first potential and the second potential; and a comparison circuit that compares the third potential and a potential at the output terminal to form a control signal and supplies the control signal to the first and second amplification paths.

2. A power supply circuit comprising:

a first amplification path in which a first potential is input and that supplies a current to an output terminal when a control signal is in a first state;

a second amplification path in which a second potential is input and that absorbs current from the output terminal when a control signal is in a second state;

an intermediate potential forming circuit that forms a third potential between the first potential and the second potential; and a comparison circuit that compares the third potential and a potential at the output terminal to form a control signal and supplies the control signal to the first and second amplification paths.

3. The power supply of claim 2 wherein the first amplification path further comprises an inverter coupled between the at least one third P-channel transistor and a source of the first potential.

4. A power supply circuit comprising:

a first amplification path in which a first potential is input and that supplies a current to an output terminal when a control signal is in a first state;

a second amplification path in which a second potential is input and that absorbs current from the output terminal when a control signal is in a second state;

an intermediate potential forming circuit that forms a third potential between the first potential and the second potential; and a comparison circuit that compares the third potential and a potential at the output terminal to form a control signal and supplies the control signal to the first and second amplification paths;

wherein the second amplification path further comprises:

a differential amplifier formed from a plurality of first N-channel transistors and a plurality of P-channel transistors;

at least one second N-channel transistor at an output stage; and at least one third N-channel transistor turning on and off the at least one second N-channel transistor at the output stage.

5. The power supply of claim 4 wherein the second amplification path further comprises an inverter coupled between the at least one third N-channel transistor and the comparison circuit.

6. A power supply circuit comprising:

a first amplification path coupled to a first potential source and an output terminal;

a second amplification path coupled to a second potential source and the output terminal;

a comparator circuit including:

an inversion input coupled to a third potential source, the third potential source being between the first and second potential sources;

a non-inversion input coupled to the output terminal; and a control output coupled to the first and second amplification paths; wherein the first amplification path further comprises:

a differential amplifier formed from a plurality of first P-channel transistors and a plurality of N-channel transistors;

at least one second P-channel transistor at an output stage; and at least one third P-channel transistor turning on and off the at least one second P-channel transistor at the output stage.

7. The power supply circuit of claim 6 wherein the first amplification path includes a P-channel transistor at an output stage.

8. The power supply circuit of claim 6 wherein the second amplification path includes an N-channel transistor at an output stage.

9. The power supply of claim 6 wherein the first amplification path further comprises an inverter coupled between the at least one third P-channel transistor and the first potential source.

10. A power supply circuit comprising:

a first amplification path coupled to a first potential source and an output terminal;

a second amplification path coupled to a second potential source and the output terminal;

a comparator circuit including:

an inversion input coupled to a third potential source, the third potential source being between the first and second potential sources;

a non-inversion input coupled to the output terminal; and a control output coupled to the first and second amplification paths;

wherein the second amplification path further comprises:

a differential amplifier formed from a plurality of first N-channel transistors and a plurality of P-channel transistors;

at least one second N-channel transistor at an output stage; and at least one third N-channel transistor turning on and off the at least one second N-channel transistor at the output stage.

11. The power supply of claim 10 wherein the second amplification path further comprises an inverter coupled between the at least one third N-channel transistor and the control output of the comparator circuit.

12. The power supply circuit of claim 10 wherein the first amplification path includes a P-channel transistor at an output stage.

13. The power supply circuit of claim 10 wherein the second amplification path includes an N-channel transistor at an output stage.

14. A power supply circuit comprising:

a first amplification path coupled to a first potential source and an output terminal;

a second amplification path coupled to a second potential source and the output terminal;

a comparator circuit including:

a non-inversion input coupled to a third potential source, the third potential source being between the first and second potential sources;

an inversion input coupled to the output terminal; and a control output coupled to the first and second amplification paths;

wherein the first amplification path further comprises:

a differential amplifier formed from a plurality of first P-channel transistors and a plurality of N-channel transistors;

at least one second P-channel transistor at an output stage; and at least one third P-channel transistor turning on and off the at least one second P-channel transistor at the output stage;

wherein the at least one third P-channel transistor is directly coupled to the first potential source.

15. The power supply circuit of claim 14 wherein the first amplification path includes a P-channel transistor at an output stage.

16. The power supply circuit of claim 14 wherein the second amplification path includes an N-channel transistor at an output stage.

17. A power supply circuit comprising:

a first amplification path coupled to a first potential source and an output terminal;

a second amplification path coupled to a second potential source and the output terminal;

a comparator circuit including:

a non-inversion input coupled to a third potential source, the third potential source being between the first and second potential sources;

an inversion input coupled to the output terminal; and a control output coupled to the first and second amplification paths;

wherein the second amplification path further comprises:

a differential amplifier formed from a plurality of first N-channel transistors and a plurality of P-channel transistors;

at least one second N-channel transistor at an output stage; and at least one third N-channel transistor turning on and off the at least one second N-channel transistor at the output stage.

18. The power supply of claim 17 wherein the at least one third N-channel transistor is directly coupled to the control output of the comparator circuit.

19. The power supply circuit of claim 17 wherein the first amplification path includes a P-channel transistor at an output stage.

20. The power supply circuit of claim 17 wherein the second amplification path includes an N-channel transistor at an output stage.

* * * * *

UNITED STATES PATENT AND TRADEMARK OFFICE

CERTIFICATE OF CORRECTION

PATENT NO. : 6,501,252 B2
DATED : December 31, 2002
INVENTOR(S) : Takashi Fujise It is certified that error appears in the above-identified patent and that said Letters Patent is hereby corrected as shown below:

Column 1,
Line 30, "for" should be -- form --
Line 32, "path 20" should be -- path 200 --

Column 3,
Line 10, delete "5i:"
Line 24, "V3" should be -- $V_3$ --.

Signed and Sealed this

Eighth Day of April, 2003

JAMES E. ROGAN
*Director of the United States Patent and Trademark Office*